US005810109A

United States Patent [19]

Chu

[11] Patent Number: 5,810,109

[45] Date of Patent: Sep. 22, 1998

[54] ELECTRICAL SWITCH

[75] Inventor: Raymond Wai Hang Chu, Hong Kong, Hong Kong

[73] Assignee: Defond Manufacturing Limited, Chai Wan, Hong Kong

[21] Appl. No.: 767,926

[22] Filed: Dec. 17, 1996

[30] Foreign Application Priority Data

Dec. 18, 1995 [GB] United Kingdom ..... 9525831

[51] Int. Cl.[6] ..... H01H 9/00

[52] U.S. Cl. ..... 200/308; 200/315

[58] Field of Search ..... 200/308–317; 116/200, 279, DIG. 28

[56] References Cited

U.S. PATENT DOCUMENTS

| | | | |
|---|---|---|---|
| 3,610,860 | 10/1971 | Baldwin | 200/308 |
| 3,794,800 | 2/1974 | Bodge . | |
| 3,928,743 | 12/1975 | Ohashi . | |
| 3,930,135 | 12/1975 | Kodaira . | |
| 4,013,857 | 3/1977 | Tanaka | 200/315 |
| 4,024,367 | 5/1977 | Kodaira et al. . | |
| 4,191,873 | 3/1980 | Woodard | 200/315 X |
| 4,321,442 | 3/1982 | Tanaka et al. . | |
| 4,982,061 | 1/1991 | Dignal | 200/315 X |

FOREIGN PATENT DOCUMENTS

| | | |
|---|---|---|
| 1185463 | 3/1970 | United Kingdom . |
| 1252457 | 11/1971 | United Kingdom . |
| 1254460 | 11/1971 | United Kingdom . |

*Primary Examiner*—Khanh Dang
*Attorney, Agent, or Firm*—Leydig, Voit & Mayer, Ltd.

[57] ABSTRACT

An electrical switch comprising a body having two switch terminals, a switching member having an a side and a window provided at the side. The switching member is supported by the body for pivotal movement between a first position in which the terminals are electrically interconnected and a second position in which the terminals are electrically disconnected. The switch includes an indicator supported behind and arranged for exposure through the window of the switching member to indicate the switching condition of the switch through relative movement between the switching member and the indicator. The indicator has a single surface to indicate said switching condition.

13 Claims, 3 Drawing Sheets

ELECTRICAL SWITCH

The present invention relates to an electrical switch having an indicator to indicate switching condition.

SUMMARY OF THE INVENTION

According to the invention, there is provided an electrical switch comprising a body having two switch terminals, a switching member having an end/side and a window provided at said end/side, said switching member being supported by the body for pivotal movement between a first position in which the terminals are electrically interconnected and a second position in which the terminals are electrically disconnected, and an indicator supported behind and arranged for exposure through the window of the switching member to indicate the switching condition of the switch through relative movement between the switching member and the indicator, said indicator having a single surface to indicate said switching condition.

Preferably, the indicator is movable corresponding to the movement of the switching member.

More preferably, the indicator is movable by the switching member.

Further preferably, the indicator is movable through a sliding engagement with the switching member.

It is further preferred that the switching member has a slot and the indicator has a part in sliding engagement with the slot.

In a preferred embodiment, the indicator and the switching member are both movable toward and away from each other.

Preferably, the indicator is pivotable.

It is preferred that the indicator is arranged to be clearly and/or completely visible through the window only when the switch is in a closed condition.

More preferably, the indicator is arranged to be inclined at substantially right angles to the window when the switch is in an open condition.

Advantageously, the surface of the indicator is coloured.

In one preferred embodiment, the window is fitted with a magnifying lens.

In another preferred embodiment, the window is fitted with a lens having an outer side which is feelable relative to the surface of the switching member around the lens.

The aforesaid electrical switch may be in the form of a rocker switch.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
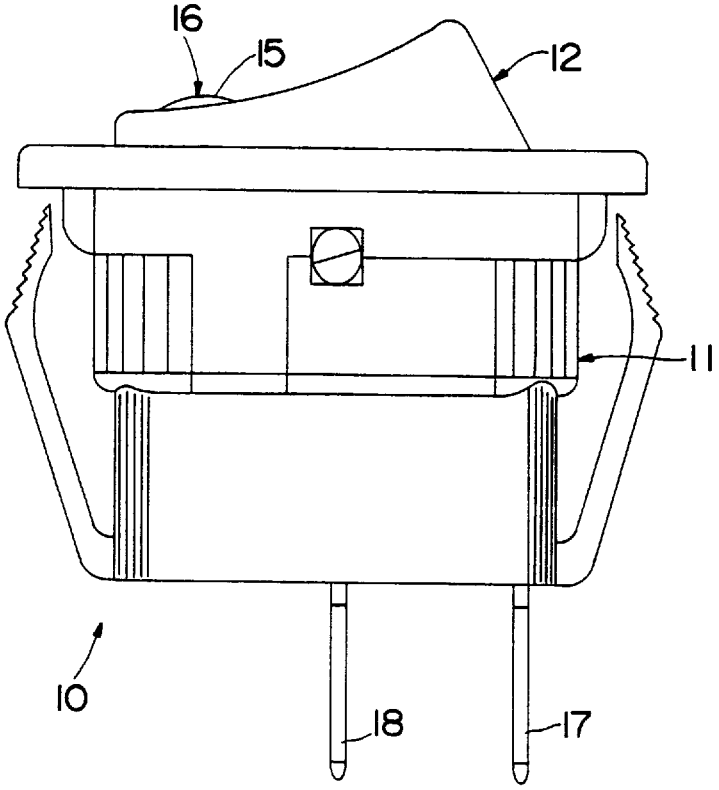
FIG. 1 is a side view of an embodiment of an electrical switch in accordance with the invention.
Figure 2:
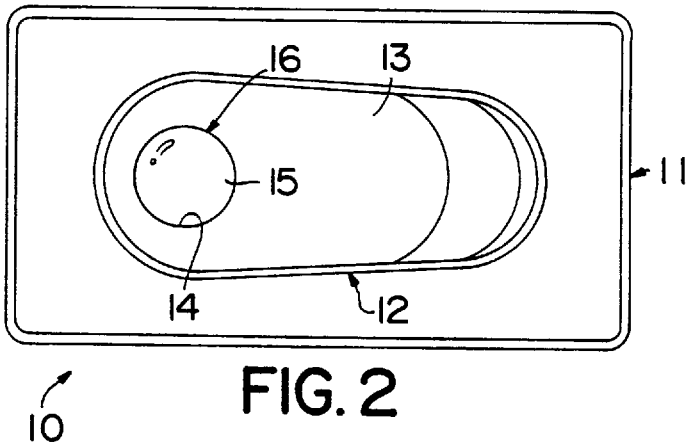
FIG. 2 is a top plan view of the switch of FIG. 1.

Referring to the drawings, there is shown an electrical switch embodying the invention, for example, in the form of a rocker switch 10. The rocker switch 10 has a plastic body/casing 11 and a plastic switching knob 12 supported within an upper portion of the casing 11 for pivoting or rocking. The knob 12 has a slightly curved up top wall 13 which is accessible for pressing to rock the knob 12 in opposite directions. The top wall 13 has opposite ends (or sides for a square or round knob) 13A and 13B and is formed, at one end 13A (left end as shown), with a circular hole 14 in which a transparent plastic lens 15 is fitted to form a window 16. The lens 15 is slightly magnifying and has an outer side that protrudes outwards from the surface of the top wall 13 so as to be easily felt relative to the surface of the top wall 13 around the lens 15.

Figure 3:
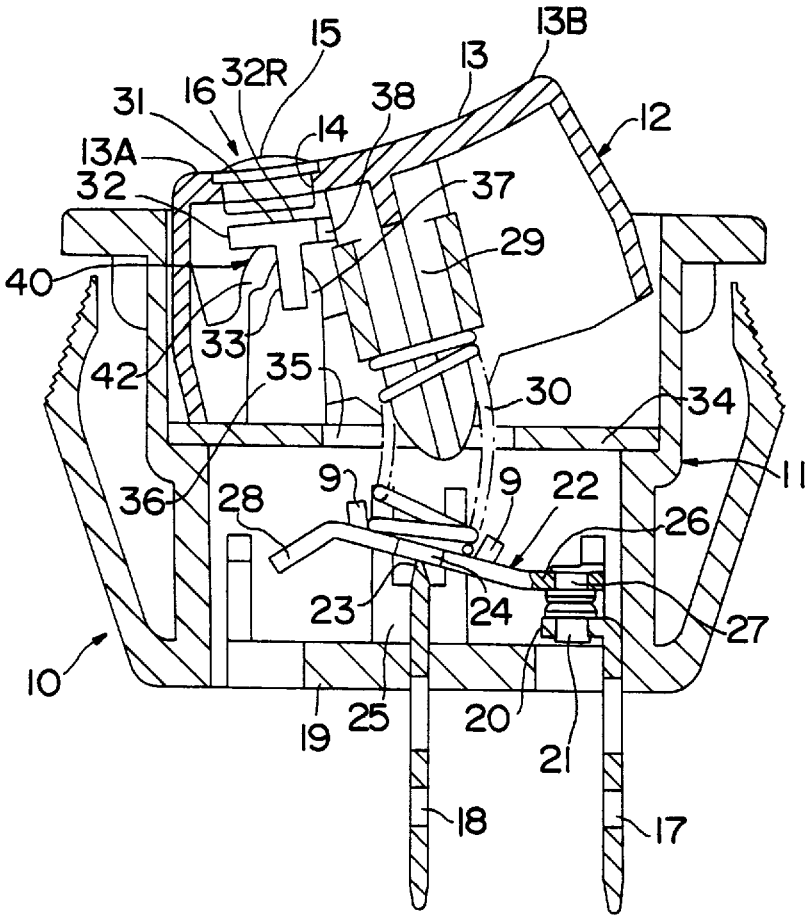
FIG. 3 is a cross-sectional side view of the switch of FIG. 1, in a switched-on condition.
Figure 4:
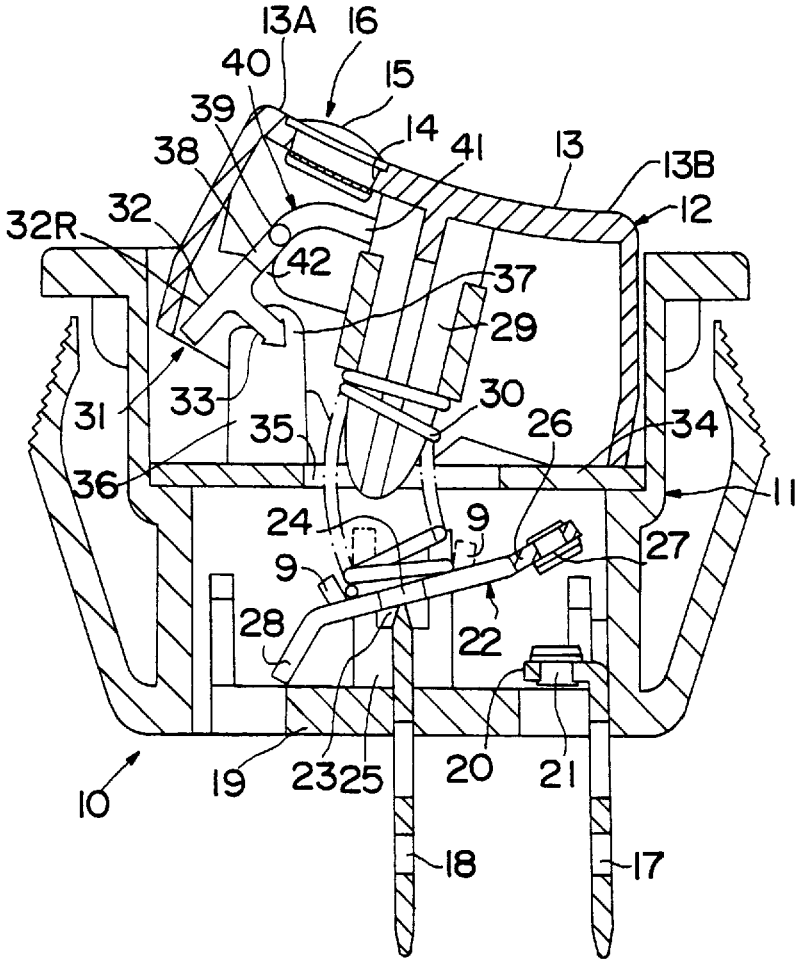
FIG. 4 is a cross-sectional view corresponding to FIG. 3, showing the switch in a switched-off condition.

Referring to FIGS. 3 and 4, the rocker switch 10 has two electrical terminals 17 and 18 which extend through one end (right end as shown) and the centre, respectively, of a bottom wall 19 of the casing 11. Uppermost end 20 of the terminal 17 is folded to lie on the bottom wall 19, through which end 20 an electrical contact in the form of a rivet 21 is fitted. An electricallyconducting lever 22 is pivoted on and about uppermost end 23 of the terminal 18. The lever 22 has a pair of wings 24 which are loosely engaged by respective bifurcated supports 25 provided on opposite inner sides of the casing 11. Front end 26 of the lever 22 is fitted with an electrical contact in the form of a rivet 27 directly above the first-mentioned rivet 21. Rear end 28 of the lever 22 is folded downwards at a small angle.

The lever 22 is pivotable between a first position (FIG. 3) in which its rivet 27 bears against the rivet 21 of the first terminal 17 and a second position (FIG. 4) in which its rear end 28 bears against the casing bottom wall 19. The terminals 17 and 18 are electrically connected together by means of the lever 22, resulting in a closed or switched-on condition of the rocker switch 10, when the lever 22 is in the first pivotal position. The rocker switch 10 is alternatively in an open or switched-off condition when the lever 22 is pivoted to the second position.

The switching knob 12 has a central depending formation 29 which holds co-axially a compression coil spring 30. The lowermost end of the spring 30 acts upon the lever 22 at a position directly opposite to that of the fulcrum acted by the uppermost end 23 of the terminal 18, being confined to that position by the supports 25 and two lugs 9 extending upwards from the lever 22. The spring 30 is slightly bent under compression to flip in opposite directions, in an off-center manner, when the knob 12 is rocked to pivot (in an opposite angular direction) the lever 22 between the first and second positions. The rocker switch 10 is maintained in its alternative switched-on or switched-off condition under the action of the spring 30 bending to the right or to the left, respectively.

The rocker switch 10 further includes an indicator 31 to indicate its switching condition with reference to the pivotal position of the switching knob 12 and lever 22. The indicator 31 comprises a disc 32 having a flat single upper surface 32R coloured red for example and a pair of legs 33 depending from the disc 32. A mounting plate 34 extends horizontally across the middle portion of the switch casing 11 between the knob 12 and the lever 22, having a central hole 35 for the spring 30 to pass through. The mounting plate 34 has an upstanding web 36, at a position below the window 16, having an uppermost end 37 to which the legs 33 of the indicator 31 are hinged such that the indicator 31 is pivotable about the web 36.

The indicator 31 includes a T-shaped bar 38 which extends out on the same plane from an inner side of the periphery of disc 32. The T-shaped bar 38 has opposite lateral ends 39. The side walls of the switching knob 12 on opposite sides of the indicator 31 have a pair of aligned curved slots 40 (as shown), along which the corresponding ends 39 of the T-shaped bar 38 are slidably engaged. Each slot 40 has an inner end 41 and an outer end 42.

In the switched-on condition of the rocker switch 10 (FIG. 3), the switching knob 12 is rocked towards the indicator 31 such that the ends 39 of the T-shaped bar 38 are slid to the inner ends 41 of the respective slots 40. As a result, the indicator 31 is hinged upright, towards the knob 12, to have its disc surface 32R aligned with and exposed through the window 16 of the knob 12. In this upright position, the disc surface 32R of the indicator 31 is clearly and completely visible through the window 16 to indicate the rocker switch's closed condition.

In the switched-off condition of the rocker switch 10 (FIG. 4), the switching knob 12 is rocked away from the indicator 31 such that the ends 39 of the T-shaped bar 38 are slid to the outer end 42 of the respective slots 40. As a result, the indicator 31 is hinged to one side, off the knob 12, to have its disc surface 32R turned away from the window 16 of the knob 12. In this turned position, the disc surface 32R of the indicator 31 is inclined at substantially right angles to the window 16 and is therefore barely visible through the window 16 to indicate, in a negative sense, the rocker switch's open condition.

The indicator 31 is pivotable to have its disc surface 32R either viewable or not viewable, exclusively, through the window 16 provided on one end of the switching knob 12.

The end of the switching knob 12 bearing the window 16 and lens 15 has to be pressed in order for the rocker switch 10 to be closed. Accordingly, the window lens 15, which is bulging outwards so as to be easily felt by a user's finger, also serves to physically mark a position for pressing to close the rocker switch 10.

In a slightly different construction, the indicator 31 may be integrally formed with the web 36, with a weakened fold-line therebetween for the indicator 31 to be pivotable about the web 36. As the switching knob 12 is inherently movable, the indicator 31 may even be fixed.

In this particular embodiment, only one end 13A of the switching knob 12 is provided with the indicator 31 for indicating the switched-off condition of the rocker switch 10. It is envisaged that the opposite end 13B of the switching knob 12 may be provided with an equivalent indicator, arranged as a mirror image compared with the indicator 31, to indicate the other, switched-on condition. Such an additional indicator may be coloured green.

The invention has been given by way of example only, and various other modifications of and/or alternations to the described embodiment may be made by persons skilled in the art without departing from the scope of the invention as specified in the appended claims.

What is claimed is:

1. An electrical switch comprising:

a body having two switch terminals;

a switching member having two opposite ends and a window provided at one of the two opposite ends, the switching member being supported by the body for pivotal movement between a first position in which the terminals are electrically interconnected and a second position in which the terminals are electrically disconnected; and a movable indicator supported behind and arranged for exposure through the window of the switching member to indicate the switching condition of the switch upon movement of the switching member and the indicator, the indicator being located at the one end and spaced from a center of the switching member having a single surface to indicate said switching condition.

2. An electrical switch as claimed in claim 1, wherein the indicator is movable through a sliding engagement with the switching member.

3. An electrical switch as claimed in claim 2, wherein the switching member has a slot and the indicator has a part in sliding engagement with the slot.

4. An electrical switch as claimed in claim 1, wherein the indicator and the switching member are both movable toward and away from each other.

5. An electrical switch as claimed in claim 1, wherein the indicator is pivotable.

6. An electrical switch as claimed in claim 1, wherein the indicator is arranged to be clearly and/or completely visible through the window only when the switch is in a closed condition.

7. An electrical switch as claimed in claim 6, wherein the single surface of the indicator is substantially perpendicular to the window when the switch is in an open condition.

8. An electrical switch as claimed in claim 1, wherein the surface of the indicator is coloured.

9. An electrical switch as claimed in claim 1, wherein the window is fitted with a magnifying lens.

10. An electrical switch as claimed in claim 1, wherein the window is fitted with a lens having an outer side that protrudes from the surface of the switching member around the lens.

11. An electrical switch as claimed in claim 1, being in the form of a rocker switch.

12. The electrical switch according to claim 1 comprising:

a mounting portion dividing an interior region of the body into first and second regions, the mounting portion including first and second surfaces;

a web portion extending upwards from the first surface of the mounting portion into the first region; and at least one leg portion extending from a lower surface of the indicator and hingedly connected to the web portion.

13. The electrical switch according to claim 12, wherein:

the switching member includes first and second curved slots located in opposing inner surfaces of the switching member;

the indicator includes first and second protrusions slidably engaging the first and second curved slots;

the first and second protrusions slide to first ends of the first and second slots, pivot the leg portion, and move the single surface of the indicator to a first position substantially parallel to the window; and the protrusions slide to second ends of the first and second curved slots, pivot the leg portion to a second position angularly spaced from the first position, and move the single surface of the indicator to a second position substantially perpendicular to the first position.

* * * * *